US009376233B2

(12) United States Patent
Gailly

(10) Patent No.: US 9,376,233 B2
(45) Date of Patent: Jun. 28, 2016

(54) EASY OPEN CLOSURE WITH IMPROVED PRESSURE PERFORMANCE

(71) Applicant: Crown Packaging Technology, Inc., Alsip, IL (US)

(72) Inventor: Noe Jacques Francois Gailly, Paris (FR)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/405,625

(22) PCT Filed: Apr. 29, 2013

(86) PCT No.: PCT/EP2013/058916

§ 371 (c)(1),
(2) Date: Dec. 4, 2014

(87) PCT Pub. No.: WO2013/182354

PCT Pub. Date: Dec. 12, 2013

(65) Prior Publication Data

US 2015/0144633 A1 May 28, 2015

(30) Foreign Application Priority Data

Jun. 7, 2012 (EP) ..... 12171187

(51) Int. Cl.
*B65D 17/353* (2006.01)
*B65D 17/40* (2006.01)
(Continued)

(52) U.S. Cl.
CPC ..... *B65D 17/163* (2013.01); *B65D 17/02* (2013.01); *B65D 2517/007* (2013.01); *B65D 2517/0016* (2013.01)

(58) Field of Classification Search
CPC ..... B65D 17/02; B65D 17/163; B65D 17/08; B65D 2517/00013; B65D 2517/0016; B65D 2517/007
USPC ..... 220/272, 270, 273, 276
See application file for complete search history.

(56) References Cited

U.S. PATENT DOCUMENTS 4,535,909 A * 8/1985 Zysset ..... 220/273
4,648,528 A * 3/1987 LaBarge et al. ..... 220/240
(Continued)

FOREIGN PATENT DOCUMENTS

DE 19805837 C1 * 7/1999
EP 1577222 A1 9/2005
(Continued)

*Primary Examiner* — J. Gregory Pickett
*Assistant Examiner* — Niki M Eloshway
(74) *Attorney, Agent, or Firm* — Baker & Hostetler LLP

(57) ABSTRACT

An easy open closure (10) for food or beverage containers and comprising a centre panel (27) surrounded by a circumferential score (16) and an outer seaming panel (17). The closure further comprises a tab (11), the tab being fixed to the centre panel by a rivet (12) formed in the centre panel (27) such that lifting of a radially inner region of the tab (11) forces a nose portion (24) of the tab into contact with a region of the centre panel adjacent to a radially inner edge of the circumferential score (16), thereby causing the score to fracture. A bead (19) is formed in and extending circumferentially around the centre panel inside and adjacent to the circumferential score (16) and at a radius outside of the rivet (12), the bead deviating inwardly from its circumferential path as it approaches the region in which the rivet (12) is formed, and the bead terminating adjacent to and on either side of the rivet.

18 Claims, 2 Drawing Sheets

(51) Int. Cl.
*B65D 17/00* (2006.01)
*B65D 17/347* (2006.01)

(56) References Cited

U.S. PATENT DOCUMENTS

2004/0099665 A1* 5/2004 McEldowney et al. ..... 220/270
2006/0060582 A1* 3/2006 Martinez Gomez ..... 220/269
2008/0197132 A1* 8/2008 Hasegawa et al. ..... 220/269
2008/0314906 A1* 12/2008 Butcher et al. ..... 220/272
2011/0186575 A1* 8/2011 Dunwoody et al. ..... 220/270
2012/0263835 A1* 10/2012 Burleson et al. ..... 426/122
2014/0346174 A1* 11/2014 Leboucher ..... 220/269

FOREIGN PATENT DOCUMENTS

FR 2716166 A1 * 8/1995
FR 2812618 A1 * 2/2002

* cited by examiner

EASY OPEN CLOSURE WITH IMPROVED PRESSURE PERFORMANCE

CROSS-REFERENCE TO RELATED APPLICATIONS

This application is the National Stage of International Application No. PCT/EP2013/058916, filed Apr. 29, 2013, which claims the benefit of European application number 12171187.3, filed Jun. 7, 2012, the disclosures of which are incorporated herein by reference in their entirely.

TECHNICAL FIELD

This invention relates to an easy open closure with improved pressure performance and, in particular to an easy open can end. The can end is typically of the "full aperture opening" type, in which a metal can end panel has a circumferential score which enables a circular panel of the end to be removable and thereby to give full access to a product within the can to which the end is fixed.

BACKGROUND

A well-known closure for a metal can comprises a can end fixed to the can body by a double seam which extends radially inwardly into a chuck wall and, optionally, a countersink to a centre panel. The circumferential score around the edge of the centre panel and adjacent the countersink and/or chuck wall, dictates the removable area of the panel. The benefit of the removal of the majority of the centre panel is the ease of access to the can contents. In the case when the can contents comprise a solid or semi-solid food product, dispensing and access to the product is relatively straightforward.

A metal tab that is fixed by a rivet to the removable centre panel has a nose portion positioned above the score. When a handle of the tab is raised relative to the can end, the nose portion of the tab pierces the score and breaks or "pops" the score over an initial arc. By pushing the tab over the seam until the tab meets the peripheral chuck wall of the end, the initial arc is propagated and tears over a larger arc of the score. In a final opening stage, the tab and end panel are pulled out away from the can body and full opening is achieved as the end peels away from the can body.

Processing, handling and storage of filled metal cans often results in increased internal pressures within the cans. This can in turn give rise to so-called "peaking" effects which may deform the can closure and even possibly fracture the closure along the circumferential score. Whilst this problem may be overcome by making closures of sufficiently thick metal plate, such an approach is undesirable as it results in significantly increased production costs. The conventional approach to mitigating peaking effects is therefore to introduce beads (sometimes referred to as "furrows") into the can closure profile to provide additional strength whilst minimising the metal plate thickness requirement.

FIG. 1 is a plan view of an easy open can end. The end includes a series of terraces 1, a circumferential score 2, a seaming panel 3, and wing-shaped beads 4 adjacent a rivet 5. The can end of the FIG. 1 design has a specific chord length along which the panel folds when the tab 6 is raised for opening. This chord is illustrated by the broken line 9 in the Figure.

The design of FIG. 1 may be improved, at least in respect of its pressure performance, by including a bead that extends around the entire circumference of the closure, and which passes between the score 2 and the nose portion 8 of the tab 6.

This bead is indicated by reference numeral 7 in FIG. 1. The bead 7, and its location close to and parallel with the score 2, strengthens the closure in the region of the score 2, tending to prevent unintended fracturing of the score.

The design of the can closure illustrated in FIG. 1 has a number of disadvantages. Whilst it does achieve a satisfactory pressure performance, its opening performance is not so good primarily due to the short length of the chord 9 between the two points where it intersects with the score. This is caused by the presence of the strengthening bead 7 between the nose portion 8 and the score 2 which tends to prevent an initial fracture of the score, induced when the tab is raised, from propagating around the score to a sufficient extent.

A solution to this problem is to terminate the bead 7 on each side of the tab 6, i.e. to provide a break in the bead 7 in the region behind the tab. However, it has been found that merely terminating the bead 7 results in an increased risk of peaking along the score line in the region of the break. A further solution that has been proposed, see EP1577222, is to maintain the bead 7 as shown in FIG. 1, and introduce an additional pair of relatively short beads on either side of the rivet 5. These project outwardly from the rivet region in a generally circumferential direction. The additional beads provide a fold line about which the closure tends to fold when the tab is raised, counteracting the strengthening effect of the bead 7.

An important feature of can closures is their ability to resist abuse during transport and stacking. A particular problem in this regard is the possibility that when a filled can is stacked on top of another filled can, e.g. during transport, the base of the upper can pushes down on the tab of the lower can. This can cause the score formed around the closure of the lower can to fracture. A known solution to this problem is to form a pair of downwardly projecting points or nibs on either side of the tab and which project slightly further than the point of the tab nose. These additional points typically make contact with the surface of the closure in the unopened configuration and, in the event of an impact on the can, e.g. due to stacking, prevent the nose from coming into contact with the can closure. When the handle of the tab is raised to open the closure however, the tab tends to pivot about these points allowing the nose to impact the closure and fracture the score. It is possible to achieve a similar effect by providing a pair of raised dimples on the closure, under and in contact with the tab.

Considering again the design of FIG. 1 and other designs such as EP1577222 that provide a circumferential bead extending behind the nose of the tab, this bead will tend to interfere with the abuse protection points or dimples described in the preceding paragraph.

SUMMARY

It is an object of the present invention to provide a can closure which has both satisfactory pressure performance and satisfactory opening performance, whilst still being able to accommodate abuse resistance features.

According to an aspect of the present invention there is provided an easy open closure for food or beverage containers and comprising a centre panel surrounded by a circumferential score and an outer seaming panel. The closure further comprises a tab, the tab being fixed to the centre panel by a rivet formed in the centre panel such that lifting of a radially inner region of the tab forces a nose portion of the tab into contact with a region of the centre panel adjacent to a radially inner edge of the circumferential score, thereby causing the score to fracture. A bead is formed in and extending circumferentially around the centre panel inside and adjacent to the circumferential score and at a radius outside of the rivet, the bead deviating inwardly from its circumferential path as it approaches the region in which the rivet is formed, and the bead terminating adjacent to and on either side of the rivet.

At least certain embodiments of the invention are able to provide a space behind the rivet across which the bead does not pass, such that this space can be used to accommodate abuse resistance features.

The centre panel may comprise a witness surrounding the rivet, the witness having been formed as a result of a bubble reform procedure, said bead terminating on either side of the rivet at or close to the outer periphery of the witness.

The centre panel may be substantially flat in the region between the rivet and the score, with the tab being provided on an under surface with two or more abuse prevention points, these points being configured to be in contact or very close proximity with the substantially flat region prior to user activation of the tab. Alternatively, the substantially flat region may be provided on an upper surface with two or more abuse prevention dimples, these dimples being configured to be in contact or very close proximity with an under surface of the tab prior to user activation of the tab.

The bead may follow a generally linear path in the region approaching the rivet such that, when the tab is lifted away from the centre panel, a fold in the centre panel is created along that generally linear path.

DETAILED DESCRIPTION

Figure 1:
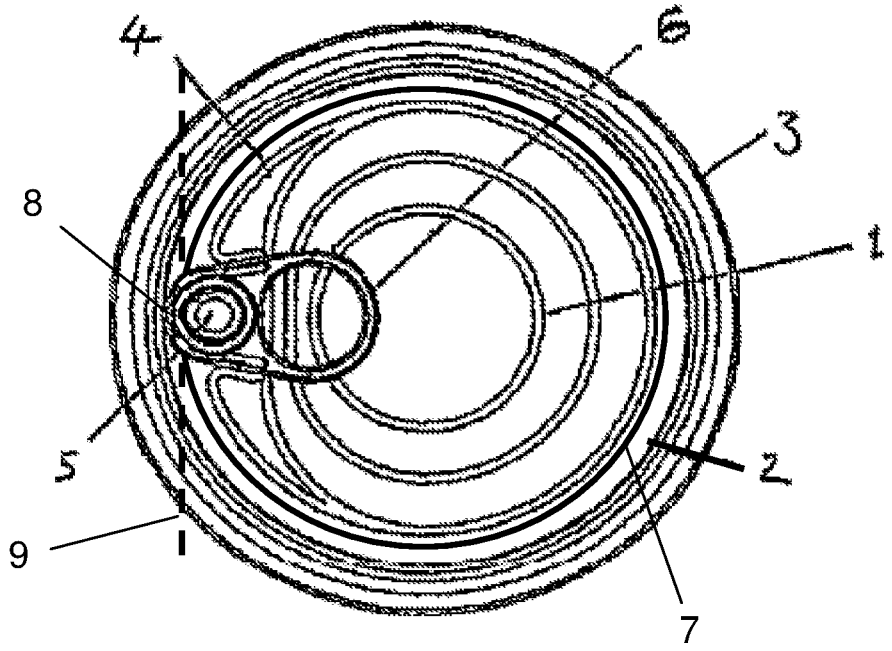
FIG. 1 shows schematically a top side view of a known easy open can closure.
Figure 2:
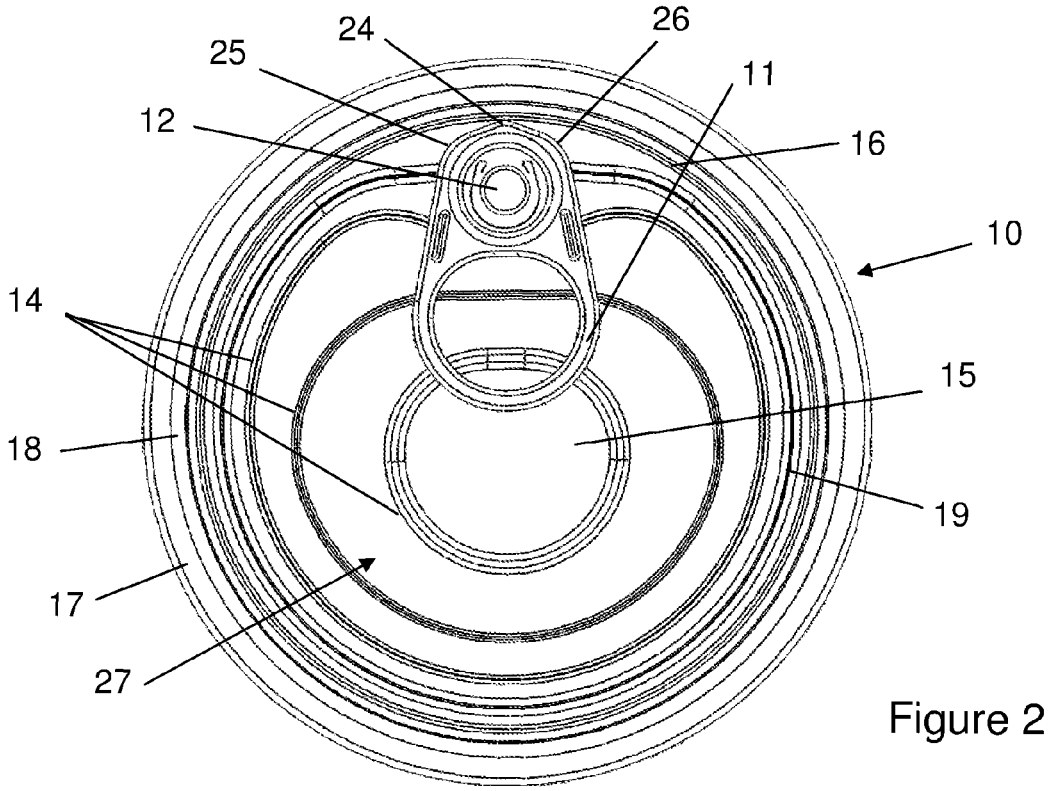
FIG. 2 shows schematically a top side view of an improved easy open can closure.

With reference to FIG. 1, the problems associated with known can closures have been discussed above. In particular, a need has been identified for a can closure that has both satisfactory pressure performance and satisfactory opening performance, whilst still being able to accommodate abuse resistance features. Such a can closure will now be described with reference to FIGS. 2 and 3 which show, respectively, a top side view and an under side view of the improved can closure. The can closure is indicated generally by reference numeral 10, and includes a number of conventional features including;

A centre panel indicated generally in FIG. 2 by the reference numeral 27.

A tab 11 riveted to the can closure. The tab has a nose portion 24. The rivet 12 is produced using a known "bubble reform" process which generates a circular "witness" mark 13 around the rivet. This process hardens the metal in the area of the rivet including the witness.

Panel steps 14 which give rise to a terracing profile across the diameter of the can closure, such that the region in which the tab 11 is riveted to the closure is raised with respect to a finger receiving region 15. These panel steps 14 also improve pressure and opening performance.

A circumferential score 16 that is fractured to open the can closure and which extends around the centre panel 27.

A seaming panel 17.

A chuck wall 18 inside and adjacent to the seaming panel.

Figure 3:
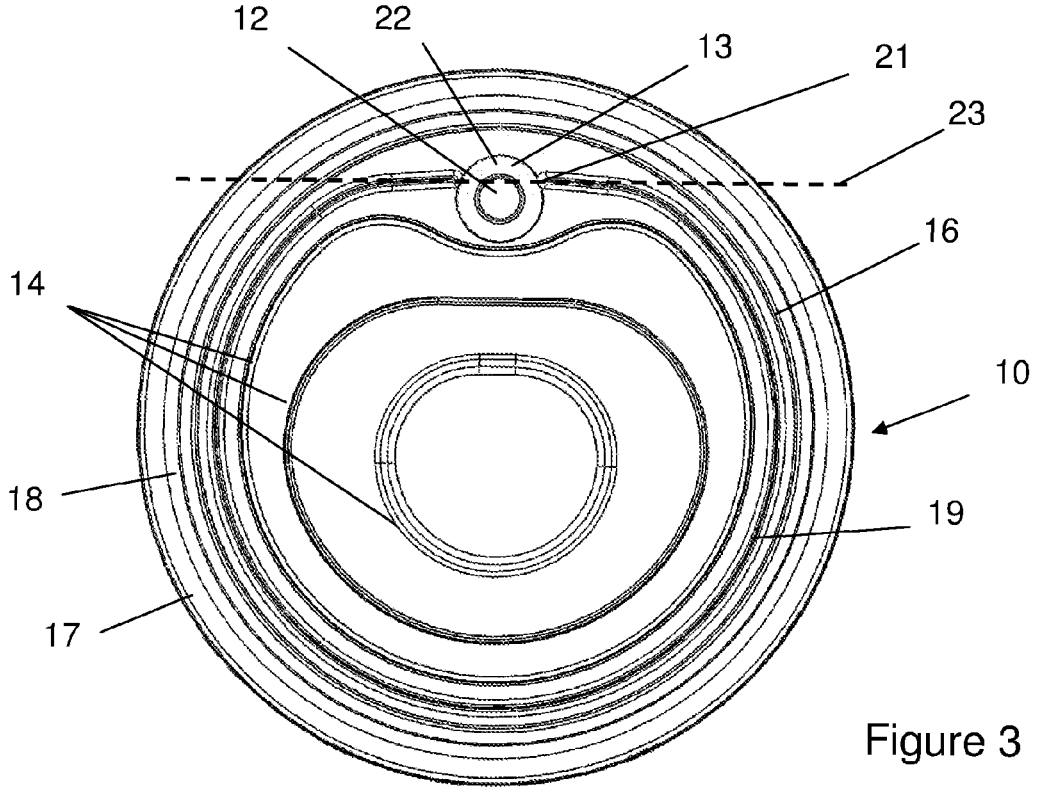
FIG. 3 shows schematically an under side view of an improved easy open can closure.

In order to provide a satisfactory pressure performance, an annular bead 19 is provided inside the score 16. For most of its extent, this bead 19 follows the line of the bead 7 of the can closure illustrated in FIG. 1 in so far as it is adjacent to and parallel with the score 16. However, rather than continuing behind the rivet, the bead 19 deviates inwardly from its circumferential path as it approaches the region in which the rivet is formed, deviating from its otherwise circular path, starting at a location in line with or close to the centre of the rivet 12. The bead 19 terminates on either side of the rivet at terminating ends 20 and 21, at or about the points where the bead meets the outer periphery of the witness 13 formed as a result of the bubble reform process. Referring to FIG. 3, broken line 23 illustrates that the bead 19 follows a generally linear path as it approaches the witness 13.

The exact locations of terminating ends 20 and 21 of the bead 19 may depend upon a number of factors. The locations may be slightly before or after the witness periphery, or may exactly coincide with that periphery.

When a user opens the can closure by raising the handle of the tab 11, the nose 24 is pressed against the upper surface of the closure 10, causing the score 16 to fracture initially at this point. This fracture propagates along the score 16 substantially up to the points where the score 16 intersects with the broken line 23 (FIG. 3). The closure tends to fold around the line 23. In contrast with the design of FIG. 1, there is no bead behind the rivet to inhibit the fracture of the score.

It will be further appreciated that the area between the rivet 12 and the score 16 is substantially flat, with only the witness 13 providing a slight deformation close to the rivet. There is therefore nothing to interfere with abuse prevention points or nibs that might be provided on the under surface of the tab (see locations 25 and 26 indicated in FIG. 2). Similarly, there is nothing to interfere with abuse prevention dimples projecting upwardly from the surface of the closure (again at locations 25 and 26 of FIG. 2).

It will be appreciated by the person of skill in the art that various modifications may be made to the above described embodiment without departing from the scope of the present invention. For example, rather than terminating the bead 19 at its intersections with the witness 13, the bead may terminate at other locations close to the rivet. For example, a metal forming operation may be used to produce a strengthened metal area around the rivet, in addition to or instead of the witness 13, with the bead 19 terminating at or close to that strengthened metal area.

The invention claimed is:

1. An easy open closure for food or beverage containers comprising a centre panel surrounded by a circumferential score and an outer seaming panel, the closure further comprising:

a tab, the tab being fixed to the centre panel by a rivet formed in the centre panel such that lifting of a radially inner region of the tab forces a nose portion of the tab into contact with a region of the centre panel adjacent to a radially inner edge of the circumferential score, thereby causing the score to fracture; and a bead formed in and extending circumferentially around the centre panel inside and adjacent to the circumferential score and at a radius outside of the rivet, the bead deviating inwardly from its circumferential path as it approaches the region in which the rivet is formed, and the bead terminating at terminating ends disposed adjacent to and on either side of the rivet.

2. An easy open closure according to claim 1, the centre panel comprising a witness surrounding the rivet, the witness having been formed as a result of a bubble reform procedure, said terminating ends disposed on either side of the rivet at or close to an outer periphery of the witness.

3. An easy open closure according to claim 1, the centre panel being substantially flat in a region between the rivet and the score.

4. An easy open closure according to claim 3, said tab being provided on an under surface with two or more abuse prevention points, the two or more abuse prevention points being configured to be in contact or very close proximity with the substantially flat region prior to user activation of the tab.

5. An easy open closure according to claim 3, the substantially flat region being provided on an upper surface with two or more abuse prevention dimples, the two or more abuse prevention dimples being configured to be in contact or very close proximity with an under surface of the tab prior to user activation of the tab.

6. An easy open closure according to claim 1, the bead following a generally linear path in the region approaching the rivet such that, when the tab is lifted away from the centre panel, a fold in the centre panel is created along that generally linear path.

7. An easy open closure according to claim 1, wherein the terminating ends are disposed immediately adjacent to the region in which the rivet is formed.

8. An easy open closure according to claim 1, wherein the bead is immediately adjacent to the circumferential score.

9. An easy open closure according to claim 1, wherein a portion of the closure disposed radially outward from the bead and radially inward from the circumferential score is substantially flat.

10. An easy open closure for a container, the closure comprising:

a centre panel;

a circumferential score disposed about the centre panel;

an outer seaming panel disposed radially outward from the circumferential score;

a tab, the tab fixed to the centre panel by a rivet such that a nose portion of the tab is configured to contact a region of the centre panel adjacent to a radially inner edge of the circumferential score during opening of the closure, thereby causing the score to fracture; and a bead defining an annular portion that extends inside and adjacent to the circumferential score and at a radius outside of the rivet, the bead further defining a pair of portions on either side of the rivet that each extends radially inwardly relative to the annular portion and terminate at terminating ends disposed adjacent to and on either side of the rivet.

11. An easy open closure according to claim 10, the centre panel comprising a witness surrounding the rivet, the witness formed by a bubble reform procedure, the terminating ends disposed on either side of the rivet at or close to an outer periphery of the witness.

12. An easy open closure according to claim 11, said tab disposed on an under surface with two or more abuse prevention points, the two or more abuse prevention points being configured to be in contact or in very close proximity with the substantially flat region prior to user activation of the tab.

13. An easy open closure according to claim 11, the substantially flat region on an upper surface defining two or more abuse prevention dimples, the two or more abuse prevention dimples being configured to be in contact or in very close proximity with an under surface of the tab prior to user activation of the tab.

14. An easy open closure according to claim 10, wherein the centre panel is substantially flat between the rivet and the score.

15. An easy open closure according to claim 10, wherein the pair of portions on either side of the rivet are each disposed along a substantially linear path such that, when the tab is lifted away from the centre panel, a fold in the centre panel is created along the substantially linear path.

16. An easy open closure according to claim 10, wherein the terminating ends are disposed immediately adjacent to the rivet.

17. An easy open closure according to claim 10, wherein the bead is immediately adjacent to the circumferential score.

18. An easy open closure according to claim 10, wherein a portion of the closure disposed radially outward from the bead and radially inward from the circumferential score is substantially flat.

* * * * *